US007526929B2

(12) United States Patent
Takamoto et al.

(10) Patent No.: US 7,526,929 B2
(45) Date of Patent: May 5, 2009

(54) TIGHTS

(75) Inventors: Yoshikuni Takamoto, Kobe (JP); Yoshie Tsuji, Kobe (JP); Mamoru Omuro, Kobe (JP)

(73) Assignee: ASICS Corporation, Kobe (JP)

( * ) Notice: Subject to any disclaimer, the term of this patent is extended or adjusted under 35 U.S.C. 154(b) by 0 days.

(21) Appl. No.: 11/662,941

(22) PCT Filed: Jul. 21, 2005

(86) PCT No.: PCT/JP2005/013383

§ 371 (c)(1),
(2), (4) Date: Mar. 17, 2007

(87) PCT Pub. No.: WO2006/033200

PCT Pub. Date: Mar. 30, 2006

(65) Prior Publication Data

US 2007/0256217 A1 Nov. 8, 2007

(30) Foreign Application Priority Data

Sep. 21, 2004 (JP) ..... 2004-273766

(51) Int. Cl.
*D04B 1/24* (2006.01)

(52) U.S. Cl. ..... 66/177

(58) Field of Classification Search ..... 66/171, 66/170, 175, 177, 178 A
See application file for complete search history.

(56) References Cited

U.S. PATENT DOCUMENTS 3,413,824 A * 12/1968 Kuney ..... 66/177
4,325,379 A * 4/1982 Ozbey ..... 450/116
5,109,546 A * 5/1992 Dicker ..... 2/70
5,367,708 A * 11/1994 Fujimoto ..... 2/22
5,590,548 A * 1/1997 Osborne ..... 66/177
5,819,322 A 10/1998 Dicker et al.
5,954,564 A * 9/1999 Ganz ..... 450/99
5,996,120 A * 12/1999 Balit ..... 2/67
6,186,970 B1 2/2001 Fujii et al.
6,231,488 B1 5/2001 Dicker et al.
6,430,753 B2 * 8/2002 Duran ..... 2/239
6,874,337 B2 * 4/2005 Uno et al. ..... 66/177

(Continued)

FOREIGN PATENT DOCUMENTS

EP 1016351 A1 7/2000

(Continued)

*Primary Examiner*—Danny Worrell
(74) *Attorney, Agent, or Firm*—Michael E. Zall

(57) ABSTRACT

The invention provides tights that are capable of efficiently training the psoas major while preventing discomfort of wearing the tights due to the high elastic portions provided over an area in which no load for the psoas major is required. There are provided tights characterized in that it includes a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and an area of a front side of the tights corresponding to at least the abdomen and the anterior thigh.

6 Claims, 10 Drawing Sheets

U.S. PATENT DOCUMENTS

| | | | | |
|---|---|---|---|---|
| 7,024,892 | B2 * | 4/2006 | Blakely | 66/177 |
| 7,074,204 | B2 * | 7/2006 | Fujii et al. | 602/75 |
| 7,143,453 | B2 * | 12/2006 | Duran | 2/409 |
| 7,229,390 | B2 * | 6/2007 | Fuji et al. | 482/124 |
| 7,260,961 | B1 * | 8/2007 | Kennedy | 66/177 |

FOREIGN PATENT DOCUMENTS

| | | | |
|---|---|---|---|
| EP | 1016351 | B1 | 11/2003 |
| JP | A-10-280209 | | 10/1998 |
| JP | A-1998-280209 | A | 10/1998 |
| JP | A-1998-280209 | A5 | 10/1998 |
| JP | A-2001-64801 | | 3/2001 |
| JP | A-2002-212814 | | 7/2002 |
| JP | A-2004-339623 | | 12/2004 |
| WO | WO98/43504 | | 10/1998 |

* cited by examiner

TIGHTS

TECHNICAL FIELD

The present invention relates to tights, and more particularly, to tights that are capable of strengthening the psoas major.

BACKGROUND ART

In general, tights, a type of clothing to be worn next to the skin or underwear on the human body, are used for sporting or on a daily basis. A general purpose of wearing the tights is to help increase the muscular movements and hence improve athletic ability or correct the body shape.

The tights function as supporters when they are worn, and do not intend to have a permanent effect extending over such as the time during which the tights are not worn. Therefore, for training purposes, tights that improve muscular strength by applying a load to a certain muscle when they are worn and enhancing the movement of muscles are provided (e.g., Patent Document 1)

As illustrated in FIGS. 10(A) and 10(B), high elastic portions are provided on portions of the front and back sides of the tights. It is said that the musculus gluteus maximums is trained by a high elastic portion 40 (cf. FIG. 10(A)) on the front side, and the iliopsoas muscle (generally, a part combining the psoas major with the iliac muscle is called as the iliopsoas muscle) or quadriceps muscle is trained by a high elastic portion 41 on the back side (cf FIG. 10(B)).

DISCLOSURE OF THE INVENTION

Problem to be Solved by the Invention

Among the muscles mentioned above, the psoas major is a muscle that connects the spine (the lumbar vertebra) and the inside of the femur, and that generally contributes to lift the femoral region or lift up the upper part of the body. Recently, therefore, the importance to train the psoas major by taking exercise has been recognized among athletes, etc. Further, the public also has started to recognize that the psoas major contributes to the natural S-shaped curvature of the spine (furthermore, posture correction). Training of the psoas major also has received attention as one of the general methods of keeping fit.

The tights disclosed in Patent Document 1 having the high elastic portions provided on the front and back sides of the tights can apply a load to the psoas major by the high elastic portion 41 on the back side of the tights when the femoral region is lifted, but at the same time, help increase the movement of the psoas major by the high elastic portion 40 on the front side of the tights. Thus, the load applied to the psoas major is necessarily offset, and therefore, in terms of training the muscles, it is difficult to expect a satisfactory training effect.

Further, each of the high elastic portion 40 on the front side and the high elastic portion 41 on the back side is disposed to extend to an upper end portion (the lumbar region) of the tights, such that a high elastic portion and a low elastic portion fixedly exist around the waist. Therefore, the tights provides a looser fit around the waist due to a different in elastic module between the parts, and may get roughened or wrinkled. As a result, the tights pose a problem of not providing a comfortable fit.

Therefore, it is an object of the present invention to provide tights that are capable of efficiently training the psoas major while preventing discomfort of wearing the tights due to the high elastic portions provided over an area in which no load for the psoas major is required.

MEANS FOR SOLVING THE PROBLEM

For training the muscles, it is effective to apply a load to the muscles so as to extend the same when they are being contracted. With the tights, the load can be easily generated by utilizing elastic tension of a material that forms the tights. Here, the elastic tension is produced by the product of the elastic modulus and the amount of extension. Therefore, in order to increase the elastic tension to be generated, the elastic modulus and the amount of extension, of the tights may be increased. The psoas major is a muscle that usually functions when the femoral region is lifted, and regions stretching when this movement is performed are the buttocks and posterior thigh.

Accordingly, the present inventors have reached the idea that a large elastic tension can be generated and hence a load can efficiently be applied to the psoas major by providing high elastic portions having a high elastic modulus to areas of a tights respectively corresponding to the buttocks and posterior thigh and more specifically a region thereof in which the skin is greatly stretched (hereinafter referred to as "high stretching region").

According to an aspect of the invention, there is provided tights including a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and an area of a front side of the tights corresponding to at least the abdomen and the anterior thigh.

According to another aspect of the invention, there is provided tights including a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and a front side of the tights.

In the tights according to the above-mentioned aspect, preferably, the predetermined area includes a pair of leg sections that extend downward in a height direction from one end side thereof that passes through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

In the tights according to the above-mentioned aspect, preferably, the predetermined area includes a pair of lateral sections that obliquely upwardly extend toward a position corresponding to the greater trochanter of the human body from one end side thereof that passes through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

In the tights according to the above-mentioned aspect, preferably, the predetermined area includes a central region that extends in the width direction from one end side and an opposite end side that respectively pass through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

According to the tights having the above-described structure, since the high elastic portion is provided on the high stretching region of the skin, a load is applied to the psoas major by the high elastic tension being generated, such that the psoas major can be trained. At the same time, other areas become low elastic areas, and thus, it is possible to prevent the tights from being moved more than necessary or the skin from being pulled.

Further, the "height direction" is a direction along an axis of symmetry about which the front side or the back side of the tights is symmetrical between left and right. The "anterior thigh" refers to the anterior side of the femoral region of the human body, the "posterior thigh" refers to the posterior side of the femoral region of the human body, the "glutei sulcus" refers to a border between the buttocks and the posterior thigh of the human body, the "highest points of the buttocks" refer to the most protruding points of the buttocks as seen in side view of the buttocks of the human body. The "greater trochanter" refers to an eminence situated at the superolateral junction of the neck of femur and the shaft of femur. Further, the "width direction" refers to a direction orthogonal to the height direction. The "upward" refers to a body of the tights in the height direction, and the "downward" refers to the legs of the tights in the height direction. Further, the "front side" refers to a so-called "front body part" of the tights, and the "back side" refers to a so-called "back body part" of the tights.

ADVANTAGE OF THE INVENTION

As described above, according to the tights of the invention, it is possible to efficiently train the psoas major while at the same time maintaining a comfortable fit without the necessity to provide a high elastic portion having a high elastic modulus over an area in which no load for the psoas major is required.

BRIEF DESCRIPTION OF THE DRAWINGS

FIG. 9(A) is a diagram illustrating a region corresponding to legs of the front side, FIG. 9(B) is a view illustrating an abdominal region provided to the region in FIG. 9(A), and FIG. 9(C) is a view illustrating an inguinal region provided in addition to the area in FIG. 9(B).

FIG. 10(A) illustrates a front side and FIG. 10(B) illustrates a back side.

DESCRIPTION OF REFERENCE NUMERALS

1: BODY PORTION
2: LEG PORTION
3: BACK SIDE
4: LEG CENTRAL LINE
6: INTERSECTION
7: LEG SECTION
8: POSITION CORRESPONDING TO GREATER TROCHANTER
9: LATERAL SECTION
10: CENTRAL SECTION
11: HIGH ELASTIC AREA
12: UPPER BUTTOCK AREA
13: LEG-LATERAL AREA
14: INNER THIGH AREA
15: FRONT SIDE
16: PREDETERMINED SECTION
17: LINE EDGE
18: GLUTEAL CLEFT
19: CROTCH LINE
20: CENTER POINT
21: LEG SECTION
22: LATERAL SECTION
23: CENTRAL SECTION
24: FRONT-LEG LATERAL AREA
25: ABDOMINAL AREA
26: INGUINAL AREA
40: HIGH ELASTIC PORTION OF THE FRONT SIDE
41: HIGH ELASTIC PORTION OF THE BACK SIDE
X: GLUTEAL SULCUS LINE
Y: HIGHEST-POINT LINE
Z: INTERMEDIATE LINE

BEST MODE FOR CARRYING OUT THE INVENTION

Hereinafter, embodiments of the invention will be described with reference to the accompanying drawings.

Figure 1:
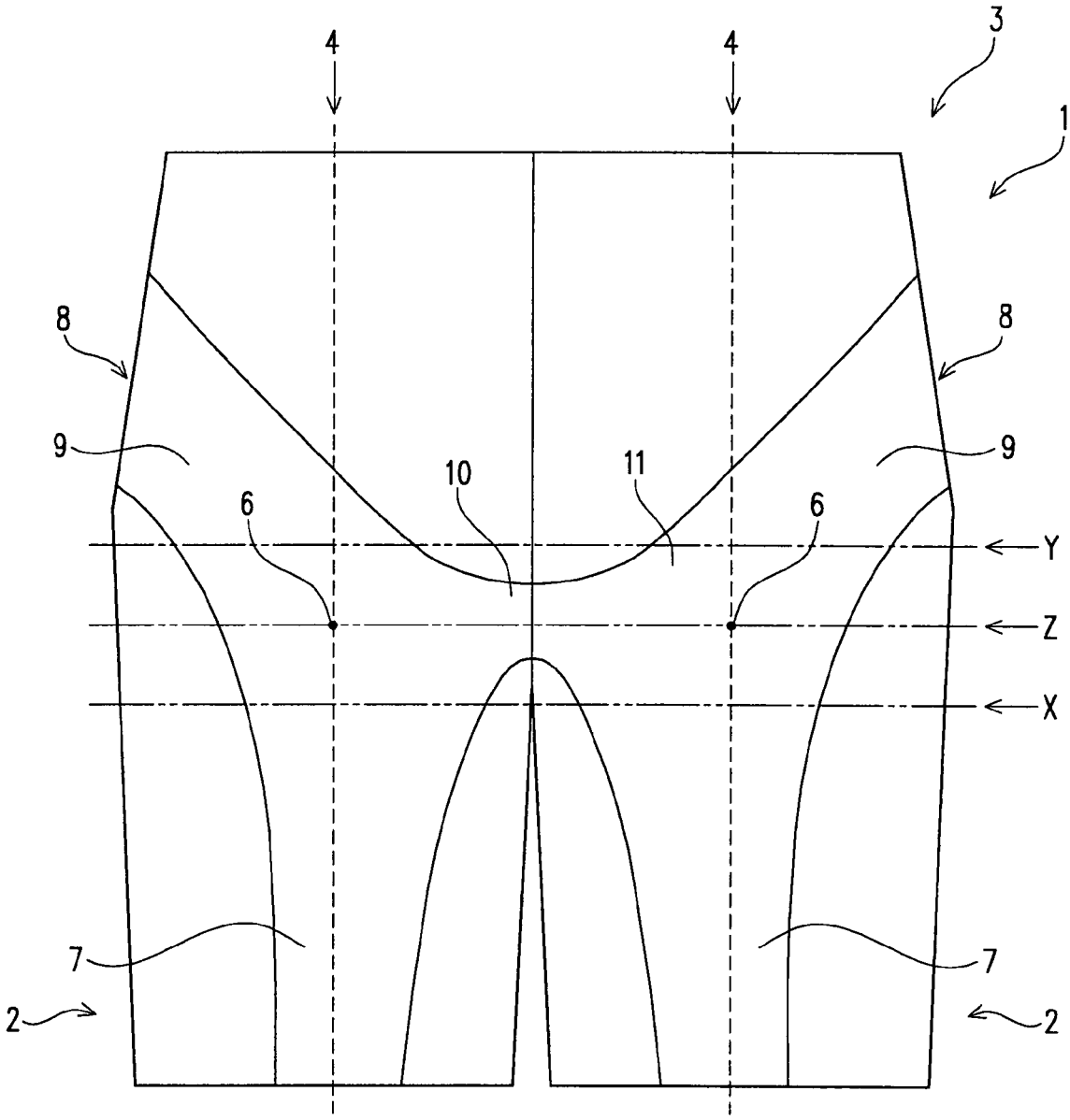
FIG. 1 is a plan view of a back side of tights according to an embodiment of the present invention.

As illustrated in FIG. 1, tights of an embodiment of the invention include a body portion 1 and a pair of leg portions 2, 2. The body portion 1 is gradually narrowed toward the upper part thereof in conformity with the shape of the waist. The pair of leg portions 2, 2 are each gradually narrowed toward the lower part thereof in conformity with the shape of the femoral region.

Further, an area 11 is formed on the back side 3. The area 11 includes a pair of leg sections 7, 7, a pair of lateral sections 9 and 9, and a central section 10. The pair of leg sections 7, 7 extend downward in a height direction from one end side thereof that passes through or close to intersections, 6, 6, the intersections 6, 6 being formed by crossing an intermediate line Z and leg central lines 4, 4 each other. The intermediate line Z extends in a width direction and is located at an intermediate height between a glutei sulks line X that conforms to the gluteal sulcus of the human body and a highest-point line Y that connects a pair of the highest points of the buttocks to each other. The pair of leg central lines 4, 4 each extend in the height direction through substantially the center of the width of the corresponding leg portion. The pair of lateral sections 9, 9 obliquely upwardly extend toward a position 8 corresponding to the greater trochanter from one end side thereof that passes through or close to the intersections 6, 6. The central section 10 extends in the width direction from one end side and an opposite end side that respectively pass through or close to the intersections 6, 6. A high elastic portion that is higher in elastic modulus in the height direction than the area of the back side 3 other than the area 11 and the front side is formed on the area 11. Hereinafter, the area of the tights where the high elastic portion is provided is referred as a "high elastic area".

Further, the tights are formed by using cloth that has an elastic modulus of the longitudinal direction different from an elastic modulus of the lateral direction. In addition, in the cloth having anisotropy, a direction in which an elastic modulus is high is referred to as a "high-elasticity direction" and a direction in which an elastic modulus is low is referred to as a "low-elasticity direction".

Figure 2:
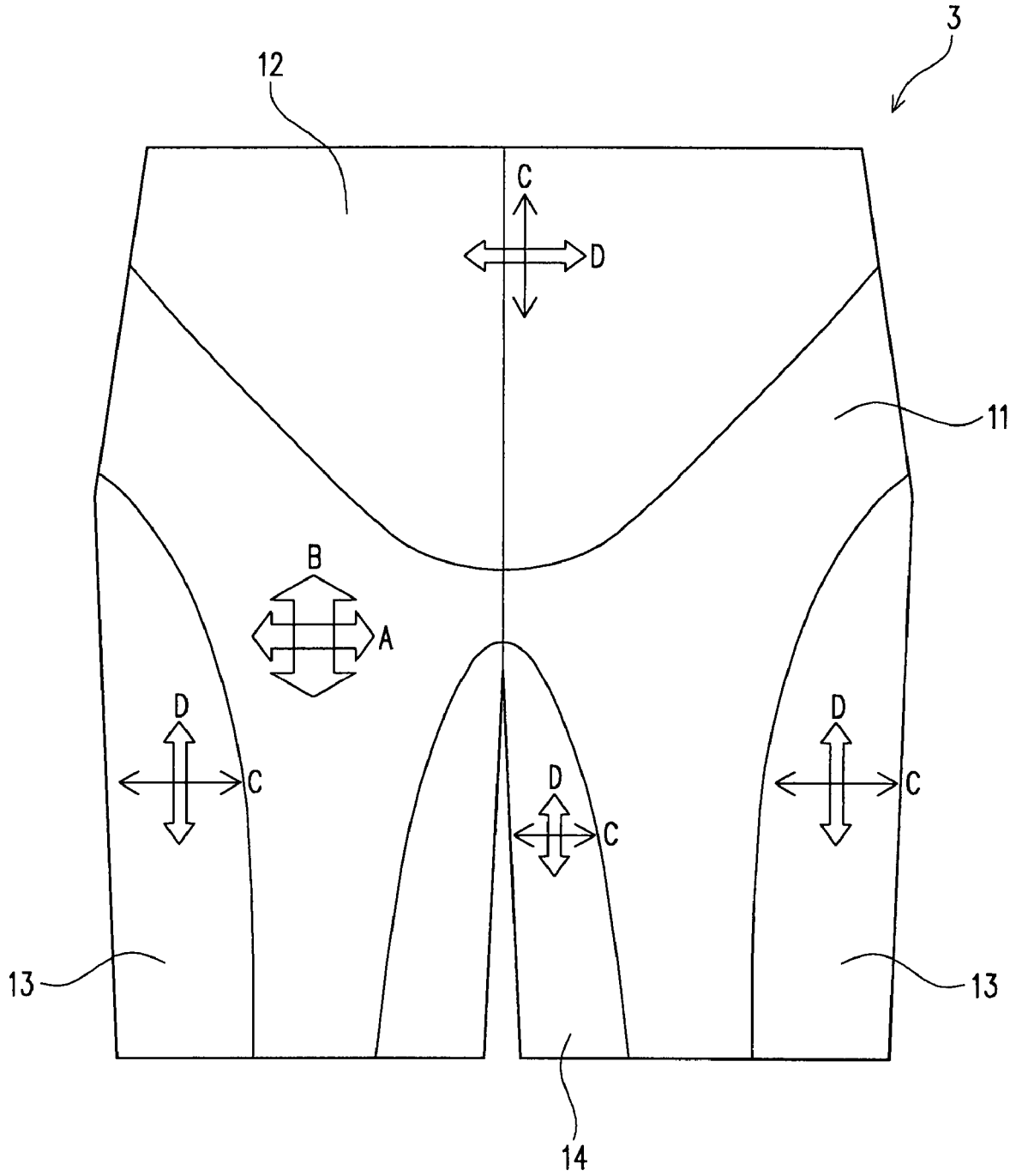
FIG. 2 is a conceptual view of an elasticity direction of the back side of the tights according to the embodiment.

As illustrated in FIG. 2, high elastic cloth is disposed on a high elastic area 11 such that a low-elasticity direction A extends along the width direction and a high-elasticity direction B extends along the height direction, that is, the high elastic cloth has a higher elastic modulus in the height direction than that in the width direction. Specifically, the elastic modulus in the height direction is approximately 1.6 times as much as that in the width direction (when the cloth is stretched 60%). In order to realize this, layers of the elastic cloth are laid over one another. For example, a power net and a 2-way tricot are joined to each other. Specifically, they are disposed such that the high-elasticity direction of the power net is oriented orthogonal to the high-elasticity direction of the 2-way tricot, and thus, the power net is stitched to a back side of the 2-way tricot. Further, the thickness of each arrow in FIG. 2 schematically indicates the relative magnitude of elastic moduli.

Further, the back side 3 of the tights is divided into four areas, namely, an upper buttock area 12, a pair of leg-lateral areas 13, 13, and an inner thigh area 14 by the high elastic area 11. Cloth that has a lower elastic modulus in the height direction than the elastic modulus of the high elastic cloth is disposed in each of the four areas.

The low elastic cloth is disposed in the upper buttock area 12 such that a low-elasticity direction C extends along the height direction and a high-elasticity direction D extends along the width direction, that is, an elastic modulus in the width direction is higher than that in the height direction. Specifically, the elastic modulus in the width direction is approximately 1.2 times as much as that of the height direction (when the cloth is stretched 60%). In order to realize this, for example, a 2-way tricot is used.

Further, the low elastic cloth is disposed in each of the pair of leg-lateral areas 13, 13 and the inner thigh area 14 such that contrary to the upper buttock area 12, the low-elasticity direction C extends along the width direction and the high-elasticity direction D extends along the height direction, that is, an elastic modulus in the height direction is higher than that in the width direction. Specifically, the elastic modulus in the height direction is approximately 1.2 times as much as that in the width direction (when the cloth is stretched 60%). In order to realize this, for example, a 2-way tricot that is the same as the cloth of the upper buttock area 12 is used. Further, the low-elasticity direction C and the high-elasticity direction D, of each of the pair of leg-lateral areas 13 and 13 and the inner thigh area 14 are oriented orthogonal to the low-elasticity direction C and the high-elasticity direction D, of the upper buttock area 12, respectively.

Figure 3:
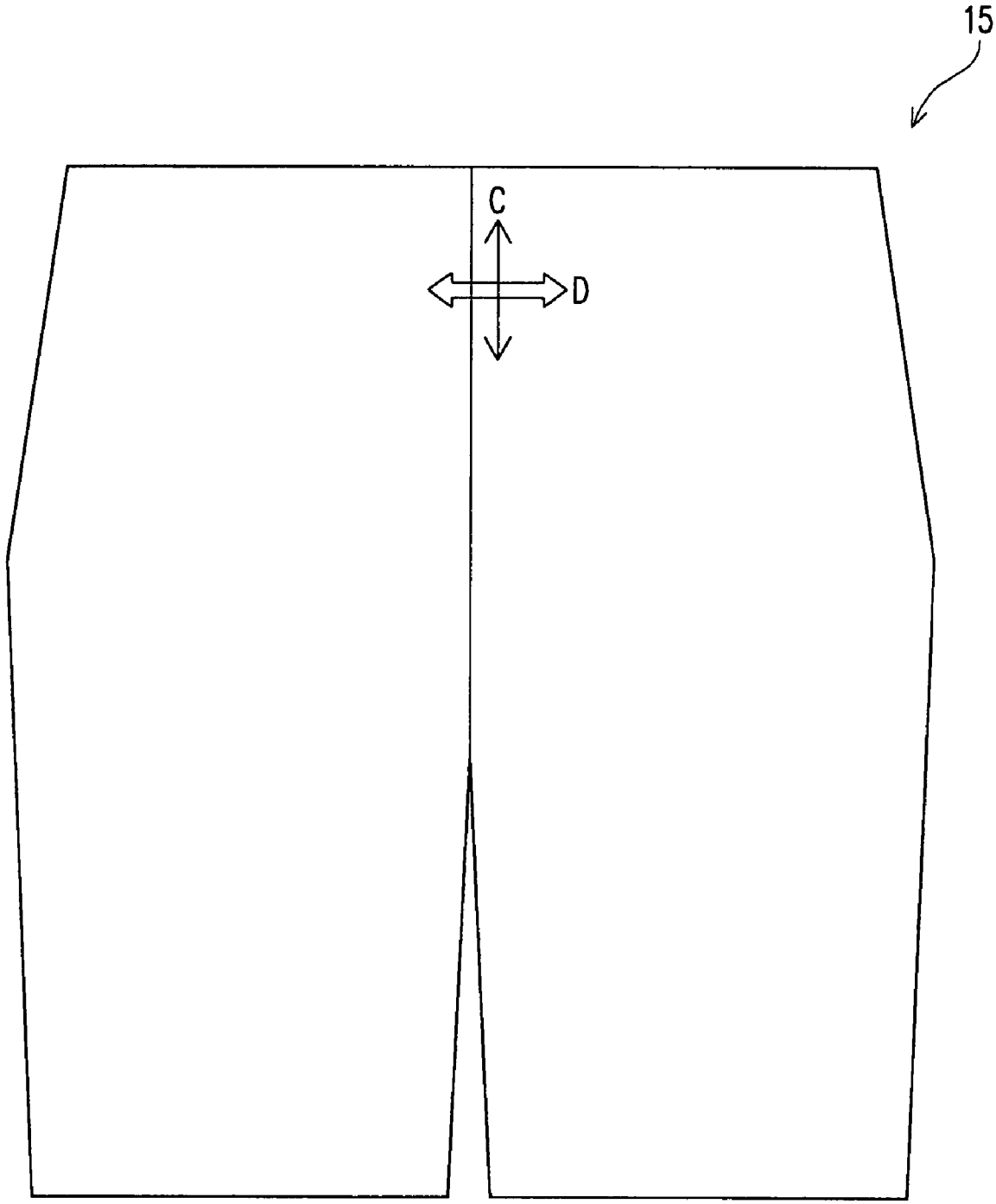
FIG. 3 is a plan view of a front side of the tights according to the embodiment.

Further, as illustrated in FIG. 3, low elastic cloth is disposed on a front side 15 of the tights such that an elastic modulus in the height direction of the cloth disposed on the front side 15 is lower than that of the cloth disposed on the high elastic area 11 of the back side 3. Specifically, the cloth is disposed such that the low-elasticity direction C extends along the height direction and the high-elasticity direction D extends along the width direction, that is, an elastic modulus in the width direction is higher than that in the height direction. More specifically, the elastic modulus in the width direction is approximately 1.2 times as much as that of the height direction (when the cloth is stretched 60%). In order to realize this, for example, a 2-way tricot that is the same as the cloth of the upper buttock area 12 or the like is used.

Further, when the high elastic cloth and the low elastic cloth are stretched 60%, the magnitude of the elastic modulus of each of the directions of the low and high elastic cloth is expressed in terms of ratio as follows. When the low-elasticity direction C of the low elastic cloth is set as 1, the high-elasticity direction D of the low elastic cloth is approximately 1.2, the low-elasticity direction A of the high elastic cloth is approximately 2.5, and the high-elasticity direction B of the high elastic cloth is approximately 4.

Figure 4:
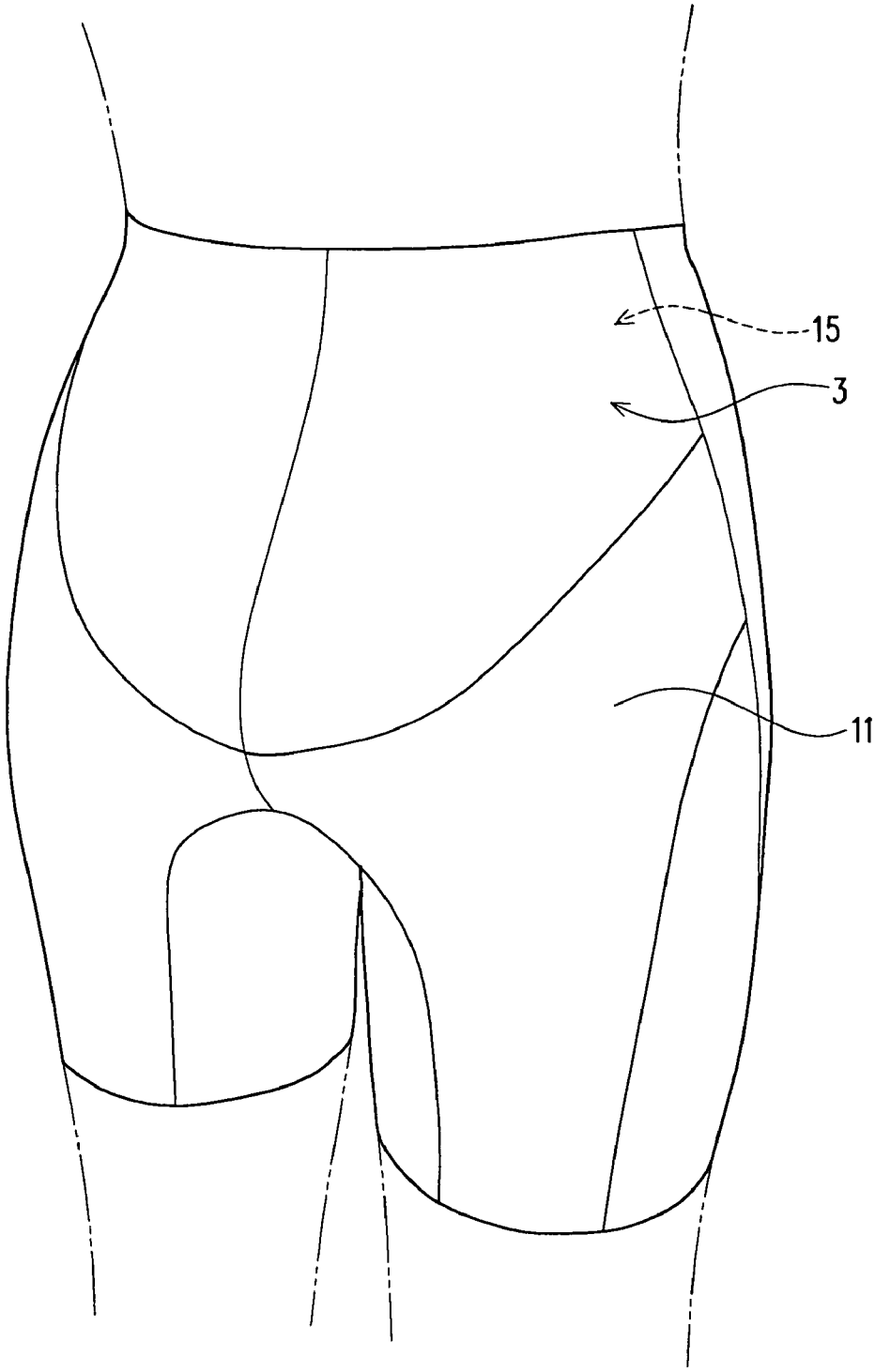
FIG. 4 is a conceptual view illustrating a state in which the tights of the embodiment are worn.

When the tights having the above-described structure are worn (cf. FIG. 4), a lifting movement of the femoral region (hereinafter, simply referred to as "hip flexion movement") causes high elastic tension at the back side of the tights, where a load is effectively applied to the psoas major, since the high elastic cloth is used for the high elastic area 11 of the back side 3. Meanwhile, since the low elastic cloth is used for the front side 15, the elastic tension occurring at the back side exceeds a support force (that is, a force helping increase the muscular movement) occurring at the front side. Therefore, the load is applied to the psoas major without reducing the elastic tension, thereby securely strengthening the psoas major.

Further, the low elastic cloth disposed in the upper buttock area 12 is more easily stretched as compared with the high elastic cloth used for the high elastic area 11 when the hip flexion movement is performed. Meanwhile, the high elastic cloth disposed in the high elastic area 11 located lower than the upper buttock area 12 has a high elastic modulus. Therefore, a portion of the high elastic cloth cannot respond to stretching of the skin during the hip flexion movement, and hence generates tension to thereby pull the tights down. At this time, the low elastic cloth disposed in the upper buttock area 12 is stretched to thereby compensate for a difference in stretching between the skin and the high elastic cloth. Therefore, it is possible to efficiently prevent the tights from being pulled down from the waist, and maintain a comfortable fit.

Further, the low elastic cloth disposed in each of the pair of leg-lateral areas 13, 13 and the inner thigh area 14 is also more easily stretched as compared with the high elastic cloth that is used for the high elastic area 11 when the hip flexion movement is performed. However, when the hip flexion movement is performed, various muscles in the femoral region contract, and thus the length around the femoral region is greatly changed. Here, the elastic tension that occurs when the high elastic cloth is used around the femoral region, is applied to various muscles in the femoral region, but is not directly applied to the psoas major. Therefore, in order to strengthen the psoas major, there is less need to use the high elastic cloth in this area. In this point, the low elastic cloth is disposed in the pair of leg-lateral areas 13, 13 and the inner thigh area 14. Whereby, the legs of the tights easily respond to a change in length around the femoral region, and thus it is possible to appropriately maintain a comfortable fit.

Further, when the hip flexion movement is performed, the low elastic cloth used on the front side 15 of the tights is more easily stretched as compared with the high elastic cloth used for the high elastic area 11. Therefore, a tightening feeling that is likely to be generated by the high elastic cloth that is used on the back side is relieved, thereby obtaining a comfortable fit.

Further, in the upper buttock area 12, since the low-elasticity direction C extends along the height direction, it is much easier for the low elastic cloth to be stretched downward. Therefore, it is possible to more efficiently prevent the tights from being pulled down from the waist, and obtain a comfortable fit. Meanwhile, the high-elasticity direction D extends along the width direction, the tights are therefore tightly fitted at the waist, and the circumference of the buttocks is generally larger than that of the waist, such that it is possible to efficiently prevent the tights around the waist from being pulled down, and obtain a comfortable fit.

Further, in the pair of leg-lateral areas 13, 13 and the inner thigh area 14, since the low-elasticity direction C extends along the width direction, it is much easier for the low elastic cloth to be stretched in the width direction. Therefore, it is possible to obtain a comfortable fit, following a change in length around the femoral region. Meanwhile, since the high-elasticity direction D extends along the height direction, a difference in elastic modulus between the low elastic cloth and the high elastic cloth disposed in the height direction of each of the legs is absorbed, thereby maintaining a comfortable fit.

Further, the front side 15 has the same arrangement of the cloth as in the upper buttock area 12, in which the low-elasticity direction C extends along the height direction, and therefore it is much easier for the low elastic cloth to be stretched downward. Hence, it is possible to more efficiently prevent the tights around the waist from being pulled down, and obtain a comfortable fit. Meanwhile, the high-elasticity direction D extends along the width direction, the tights are therefore tightly fitted at the waist, and the circumference of the buttocks is generally larger than that of the waist, such that it is possible to efficiently prevent the tights around the waist from being pulled down, and obtain a comfortable fit.

Further, from the point of view of the relationship between the high elastic cloth disposed in the high elastic area 11 of the back side 3 and the low elastic cloth disposed in the front side 15, the high-elasticity direction B of the high elastic cloth in the high elastic area 11 extends along the height direction, and the low-elasticity direction C in the front side 15 extends along the height direction. Therefore, a difference in elastic modulus is large. For this reason, when the hip flexion movement is performed, it is possible to generate higher elastic tension in the back side than in the front side, of the tights. However, the elastic tension is not offset by a support force that is generated by the low elastic cloth that is used for the front side 15, such that it is possible to satisfactorily produce an effect of training the psoas major.

Figure 5:
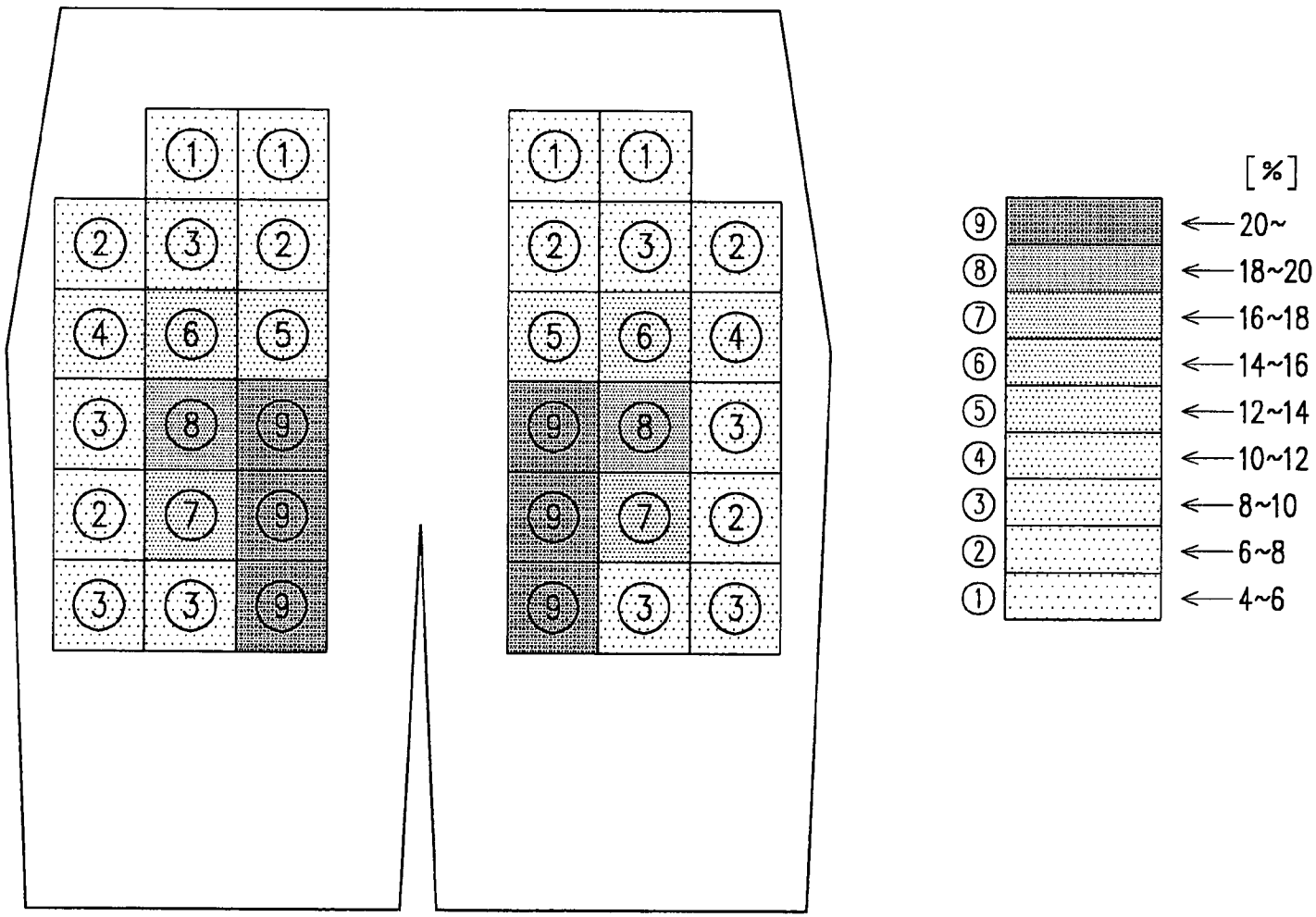
FIG. 5 is a conceptual view illustrating a degree of stretching of the human skin that occurs when the hip flexion movement is performed.

A degree to which the skin is stretched during the hip flexion movement is illustrated in FIG. 5. Further, in FIG. 5, the degree of stretching is represented by the depth of color. As shown in the scales on the right hand side of the Figure, the darker the shading is, the higher the stretching degree the portion has, and the lighter the shading is, the lower the stretching degree the portion has. For example, an area 8 is an area where the skin is stretched approximately 18 to 20% when the hip flexion movement is performed.

Figure 6:
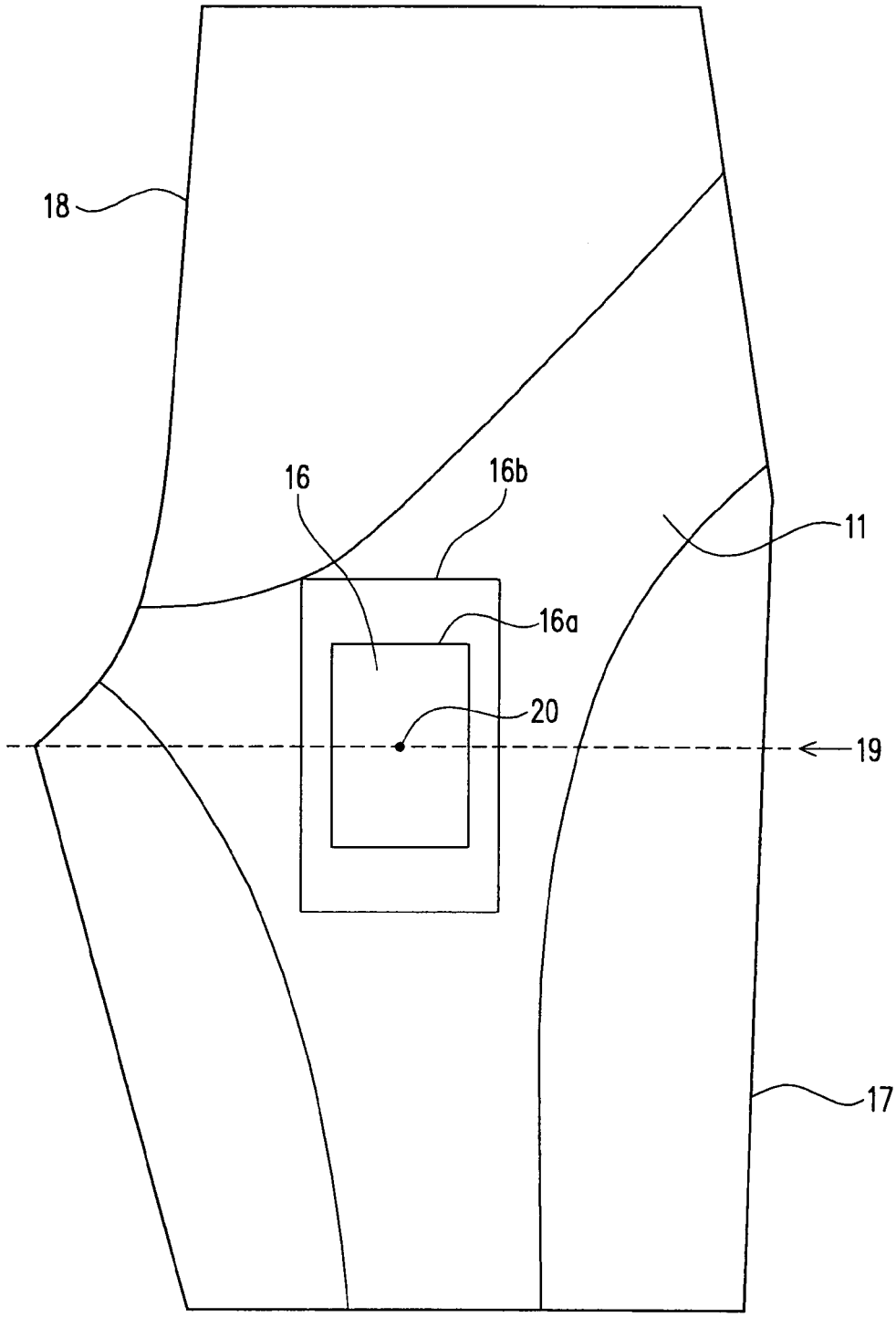
FIG. 6 is a view illustrating the tights that are folded to be symmetrical between right and left.

Therefore, in this embodiment, as illustrated in FIG. 6, in order to respond to a high stretching region, the high elastic area 11 includes at least a predetermined section 16 to be described below on the back side 3 of the tights. In FIG. 6, the tights are folded toward the front side along a gluteal cleft 18 (central line of the tights in the width direction) such that both line edges 17, 17 are overlapped. When a line along the width direction from a position at which the pair of leg portions 2, 2 are connected to each other is set as a crotch line 19, the predetermined section 16 has a quadrangular-like shape around an almost intermediate point (center point 20) of the legs along the crotch line 19, extending in the width direction and the height direction, respectively.

Specifically, the predetermined section 16 is defined as a section 16*a*. When the size of the legs along the crotch line 19 is set as reference length (e.g., 220 mm), preferably, the section 16*a* is approximately 18% or more of the reference length (e.g., 40 mm) in the width direction, and approximately 27% or more of the reference length (e.g., 60 mm) in the height direction. More preferably, the predetermined section 16 is defined as a section 16*b* that is approximately 27% in the width direction (e.g., 60 mm), and approximately 45% in the height direction (e.g., 100 mm).

Figure 7:
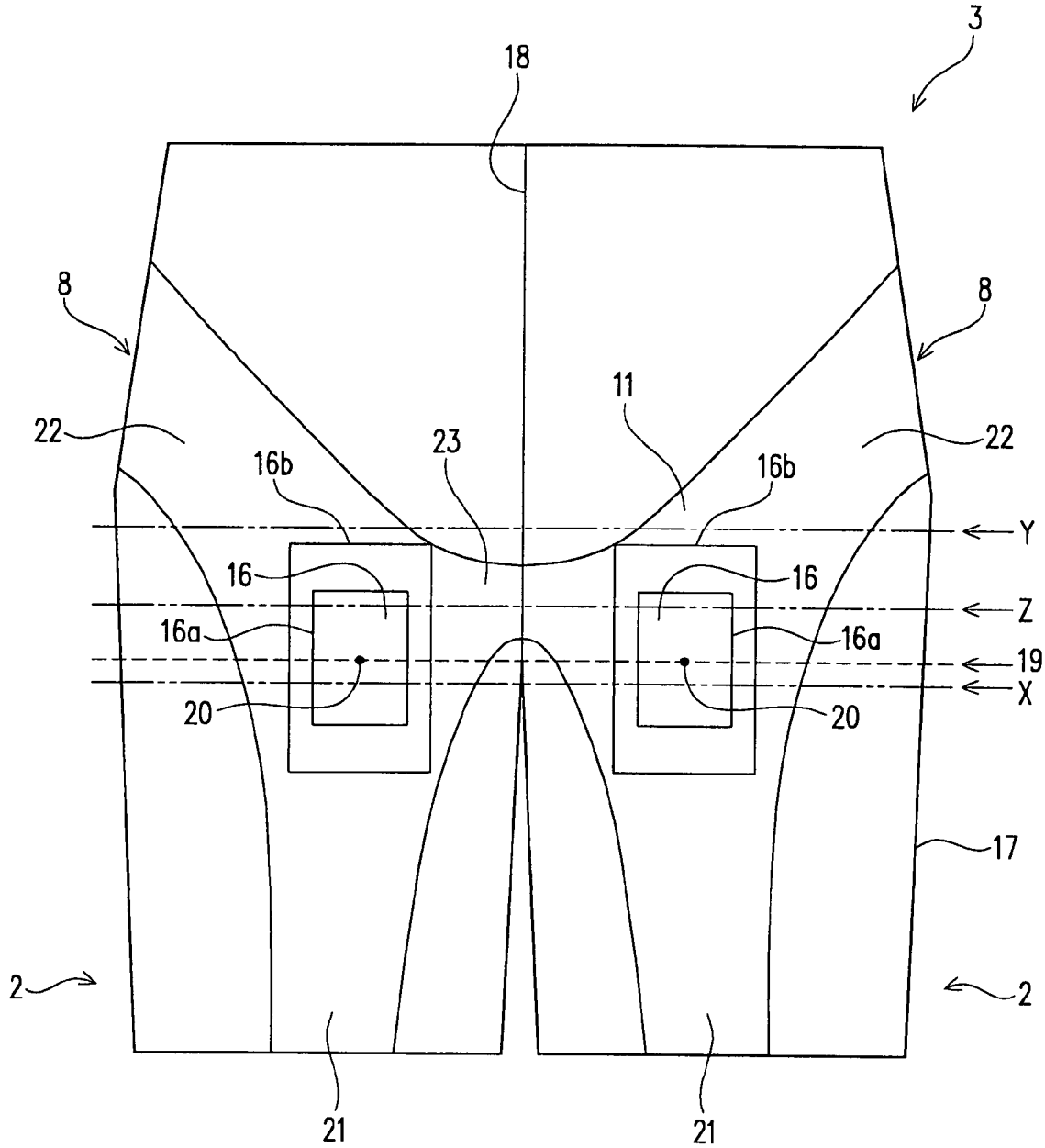
FIG. 7 is a plan view of the back side of the tights according to the embodiment.

Further, as illustrated in FIG. 7, the high elastic area 11 includes leg sections 21, which are extended downward in the height direction from the predetermined section 16, in addition to the predetermined section 16. In this way, it is possible to effectively obtain high elastic tension. Even when high elastic cloth is disposed on the leg sections 21, the high elastic cloth does not act to pull the tights down and cause discomfort. Further, the leg portions 2 of the tights conform to the shape of the femoral region in the human body, such that the tights are narrowed toward the lower part. Whereby, even when the high elastic cloth is disposed on the leg sections 21, the high elastic cloth does not act to pull the tights up.

Specifically, each of the leg sections 21 along height direction passes the intermediate point 20 along the crotch line 19, and has a width corresponding to approximately 18% or more of the reference length (e.g., 40 mm), preferably. More particularly, each leg section 21 has a width corresponding to approximately 27% or more of the reference length (e.g., 60 mm). Further, the leg sections 21 may be narrowed toward the lower part. In addition, the leg sections 21 do not necessarily reach lower ends of the tights.

More preferably, the high elastic area 11 includes the predetermined sections 16, the leg sections 21, and a pair of lateral sections 22 that obliquely upwardly extend from the high elastic area 11. In this way, it is also possible to efficiently obtain high elastic tension. Specifically, each of the lateral sections 22 has a width corresponding to approximately 18% or more of the reference length (e.g., 40 mm), preferably, on the basis of a line ranging from the center point 20 to the position 8 corresponding to the greater trichinae. More preferably, each lateral section 22 has a width corresponding to approximately 32% with respect to the reference length (e.g., 70 mm). Further, the lateral sections 22 do not necessarily reach the line edges 17 (i.e., the position 8 corresponding to the greater trochanter).

More preferably, the high elastic area 11 includes the predetermined sections 16, the leg sections 21, the lateral sections 22, and a central section 23 that connect the pair of predetermined regions 16, 16. In this way, it is also possible to efficiently obtain high elastic tension. Specifically, the central section 23 extends in the width direction from a position above the center points 20 in the predetermined area 16, and has a width corresponding to approximately 9% or more of the reference length (e.g., 20 mm) on the basis of the intermediate line Z. More preferably, the central section 23 has a width of approximately 14% with respect to the reference length (e.g., 30 mm). Further, the central section 23 may be the narrowest at a position where the central section 23 crosses the gluteal cleft 18 (i.e., a central position of the central section 23).

Using the tights having the above-described structure, an experiment that inspects an effect of correcting the S-shaped curvature as the psoas major is strengthened was performed.

In the experiment, seven female subjects are divided into two groups consisting of three and four subjects, respectively. The subjects in each group wore different tights from each other and performed, as a training, the hip flexion movement fifty times a day for four consecutive weeks.

Here, the group consisting of the four subjects wore the tights according to this embodiment, and the tights worn by the group consisting of the three subjects are general tights that do not use high elastic cloth but use only 2-way tricot formed of low elastic cloth.

Further, the same subject wore tights having lattice points on the back side thereof at predetermined intervals, and carried out the hip flexion movement. A ratio of elastic tension of the tights is calculated by multiplying values, which are obtained by measuring the amount of stretching for each interval of the respective lattice points in the high elastic area 11 of the tights of this embodiment or a corresponding area of conventional tights, by elastic moduli of cloth that are obtained by performing a material experiment. As a result, when elastic tension of the conventional tights is designated as 100, elastic tension of the tights of this embodiment was 155.

Then, a degree of the S-shaped curvature before and after the experiment was measured when the tights were not worn. The measurement was performed by measuring a posture (shape of S-shaped curvature) of the subject who was moving on a training machine (a treadmill) at approximately 4.5 km/h. Further, as illustrated in FIG. 8(A), the measurement was performed by mounting ten markers (S1 to S10) on the back of the subject from the seventh cervical vertebra to the pelvis at substantially regular intervals, and measuring positions of the respective markers by a motion capture apparatus (VICON). A result of the measurement is calculated by extracting data of sixteen steps for each landing on the left or right foot, and performing an analysis of variance. Meanwhile, a significance level is 1%.

Figure 8B:
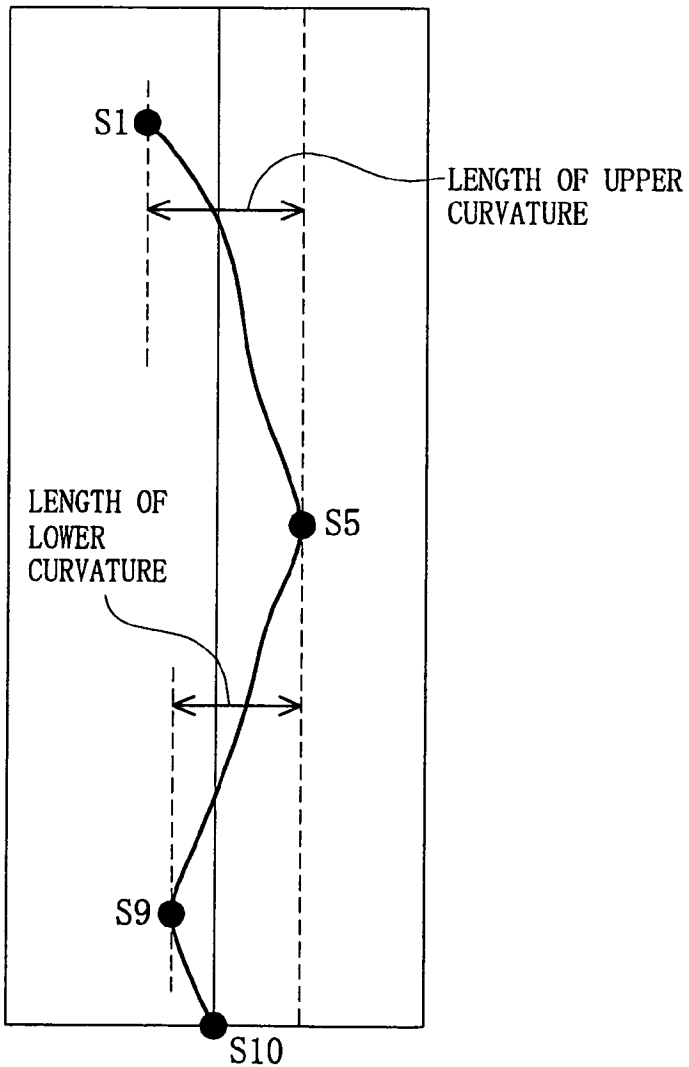
FIG. 8(B) is a view illustrating the length of the upper curvature and the length of the lower curvature that are objects to be measured.
Figure 8A:
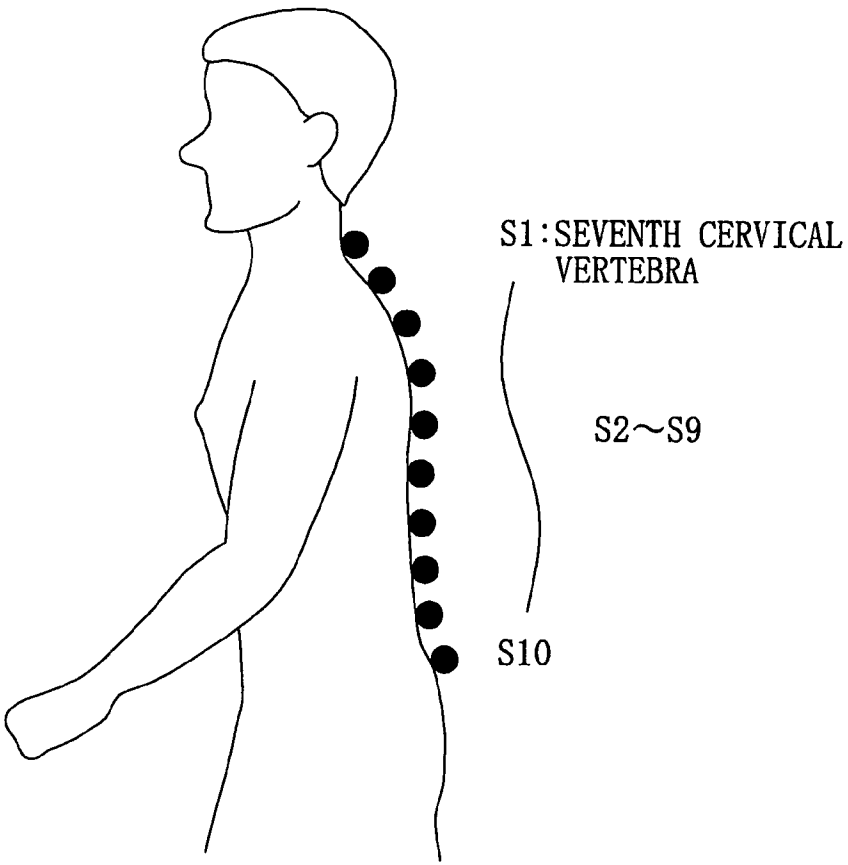
FIG. 8(A) is a view illustrating a state in which markers are attached to the back in order to measure the S-shaped curvature of the spine of the human body.

Further, as illustrated in FIG. 8(B), a length in a front and back direction of the marker S1 and the marker S5 (i.e., a length of the upper curvature) and a length in a front and back direction of the marker S5 and the marker S9 (i.e., a length of the lower curvature) are measured, and an average value of changes in length of the subjects of each group before and after the experiment is obtained. Here, the upper curvature is related to a so-called bent back. The larger upper curvature is, the more forward the subject leans, and the larger lower curvature is, the steeper S-shaped curvature is. Further, when the length of the upper curvature is smaller and the length of lower curvature is larger, it can be said that the S-shaped curvature has been improved.

As a result, it has been found that an average value of the three subjects in the group where the subjects wore the conventional tights, that is, the length of the upper curvature is reduced from approximately 52 mm to approximately 50 mm, and the length of the lower curvature is reduced from approximately 31 mm to approximately 29 mm. On the other hand, it has been found that the four subjects in the group where the subjects wore the tights of this embodiment, that is, the length of the upper curvature is reduced from approximately 40 mm to approximately 35 mm, and the length of the lower curvature is increased from approximately 31 mm to approximately 38 mm.

That is, for the conventional tights, the length of the upper curvature is improved only to the extent of approximately 3.8%, but the length of the lower curvature is worsened by approximately 6.5%. On the other hand, for the tights of this embodiment, the length of the upper curvature is improved by approximately 12.5%, and the length of the lower curvature is improved by approximately 22.6%. These are results that are obtained when the tights were not worn. Therefore, it is apparent that it is possible to efficiently strengthen the psoas major by performing the training while the tights of this embodiment are worn.

Further, the tights according to the invention is not limited to the above-described embodiment, and the described embodiment may be modified in various different ways, all without departing from the spirit or scope of the present invention.

Figure 9A:
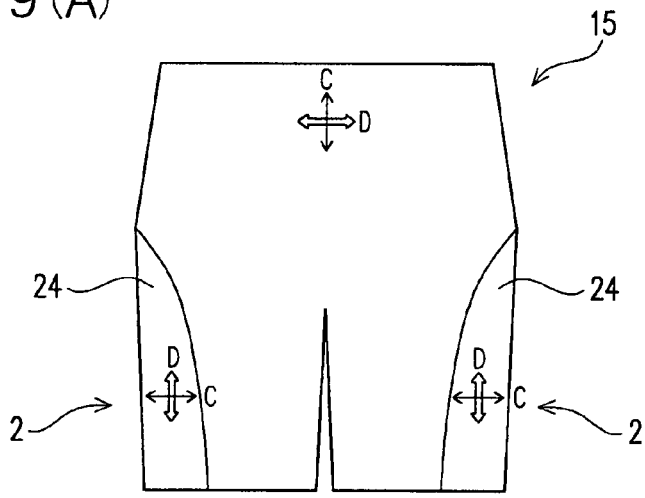
FIGS. 9(A) to 9(C) are plan views of a front side of tights according to another embodiment of the invention. More specifically.

For example, as illustrated in FIG. 9(A), on a front side 15 of tights, a pair of front-leg lateral areas 24, 24 are provided at both sides of a pair of leg portions 2, 2. Cloth is disposed on the other area such that an elastic modulus in a width direction is higher than that in a height direction, and at the same time, cloth may be disposed on the pair of front-leg lateral areas 24, 24 such that an elastic modulus in the height direction is higher than that in the width direction. In this way, the tights follow a change in length around the femoral region during the hip flexion movement, and thus it is possible to improve comfort of wearing the tights.

Figure 9B:
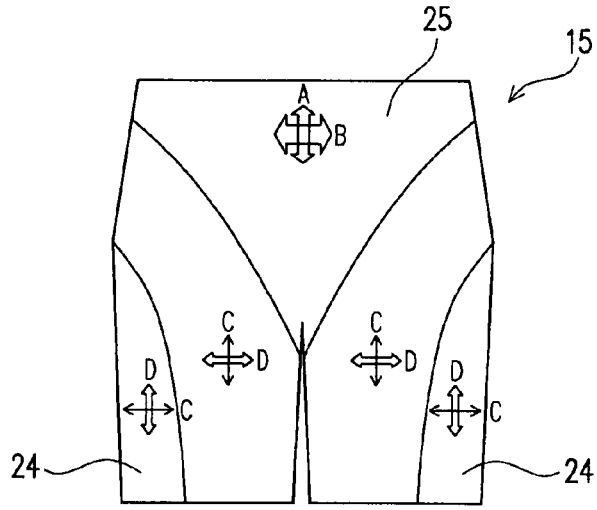

Further, as illustrated in FIG. 9(B), an abdominal area 25, which is defined by a boundary line, has one end located at the opposite lateral ends of the upper part of the tights and the other end reaching the crotch, is formed to mainly cover the abdomen. Cloth may be disposed on the abdominal area 25 such that the elastic modulus in the width direction is higher than that in the height direction. In this way, since it is possible to tight the abdominal region of the human body, a shape-up effect can be obtained.

Figure 9C:
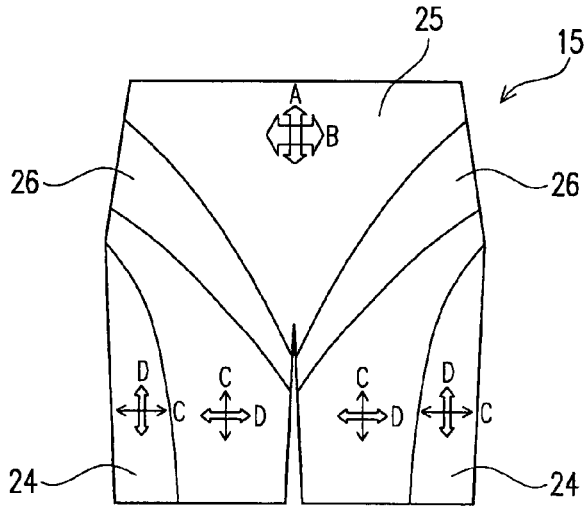
Figure 10A:
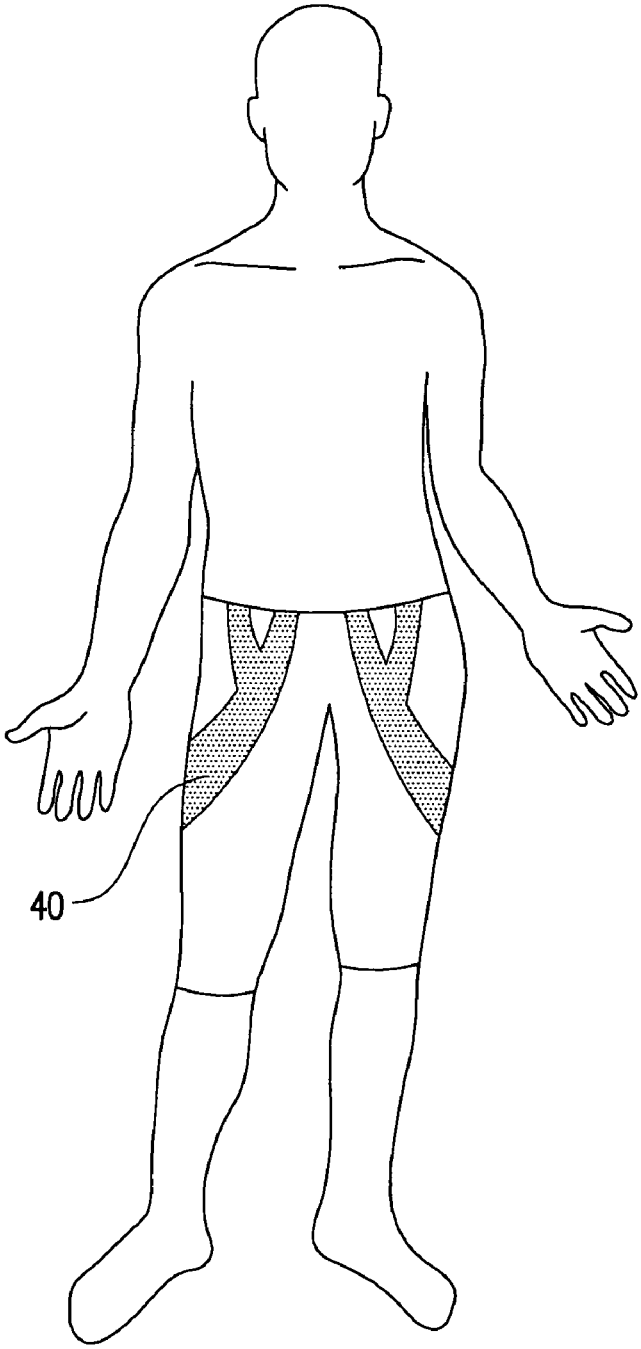
FIGS. 10(A) and 10(B) are plan views illustrating conventional tights. More specifically.
Figure 10B:
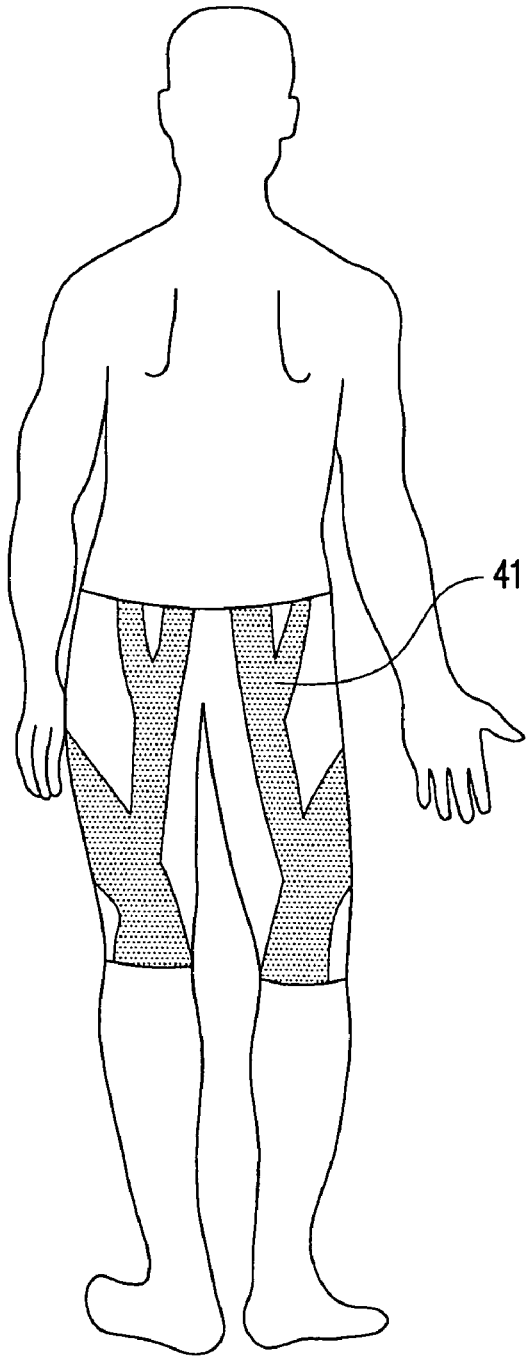

Further, as illustrated in FIG. 9(C), inguinal areas 26 are formed below the abdominal area 25. Each inguinal area 26 is defined by boundary lines that are located below the abdominal area 25 and above the corresponding front-leg lateral area 24. Cloth having a rougher texture than cloth that covers the other area may be disposed on the inguinal areas 26. In this way, a large amount of looseness or wrinkles of the cloth that occur in the inguinal region during the hip flexion movement can be effectively absorbed by the texture of the cloth, which is compressed. Thus, wearing comfort is improved.

Further, in terms of the high elastic area 11 according to the present invention, the power net serving as the high elastic cloth is stitched to the back surface of the 2-way tricot serving as the low elastic cloth. However, the power net may be stitched to the surface of the 2-way tricot, and the power net may be disposed to appear on the front surface of the tights. With this structure, uncomfortable wearing feeling due to rough texture is reduced.

Further, since the high elastic cloth is preferably disposed in the high elastic area 11 such that the elastic modulus in the height direction is higher than that of the other area, the elastic modulus in the high-elasticity direction D of the low elastic cloth may be higher than that in the low-elasticity direction A of the high elastic cloth. That is, when the low-elasticity direction C of the low elastic cloth is set as 1, for example, the high-elasticity direction D of the low elastic cloth may be approximately 2.5, and the low-elasticity direction A of the high elastic cloth may be approximately 1.2.

Further, in this embodiment, the high elastic cloth and the low elastic cloth having anisotropy are used. However, as long as two pieces of cloth have different elastic moduli from each other, each cloth having the same elastic moduli in the longitudinal direction and the horizontal direction, that is, the cloth having isotropy may be used.

Further, in this embodiment, as cloth having different elastic moduli in the high-elasticity direction and in the low-elasticity direction and/or different elastic moduli of the high elastic cloth and the low elastic cloth, the 2-way tricot or the power net is used. However, the present invention is not limited thereto, and cloth having an arbitrary elastic modulus may be used by appropriately changing yarn type, yarn density, yarn texture or yarn number.

Further, in order to provide the high elastic area, it is possible to use not only the high elastic cloth, but also a resin sheet as a high elastic member, such as polyurethane. Specifically, the high elastic area may be formed by stitching or bonding the high elastic member to the 2-way tricot, or the high elastic area may be only formed by the high elastic member such as polyurethane without using another member.

In addition, a slip-resistant member formed of rubber or the like may be mounted on an inner side of an upper end of the tights (i.e., around the waist) and/or an inner side of a lower end of each leg of the tights. In this way, it is possible to efficiently prevent the tights from being pulled down or up.

The leg portions 2 of the tights according to this embodiment correspond to the femoral region of the human body, but the leg portions 2 may be more extended downward and reach the ankles. In this case, an area of the tights that is located below the femoral region does not directly contribute to strengthen the psoas major and affect wearing feeling of the tights. Therefore, a high elastic member may be disposed in, for example, an area corresponding to an anterior or a posterior, of the calf of each leg. This does not block the strengthening of the psoas major, but makes it possible to provide tights that can be used for different purposes at the same time.

The invention claimed is:

1. Tights comprising a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and an area of a front side of the tights corresponding to at least the abdomen and the anterior thigh, wherein the predetermined area includes a pair of lateral sections that obliquely upwardly extend toward a position corresponding to the greater trochanter of the human body from one end side thereof that passes through or close to intersections, the intersections being farmed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

2. The tights according to claim 1, wherein the predetermined area includes a pair of leg sections that extend downward in a height direction from one end side thereof that passes through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

3. Tights comprising a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and an area of a front side of the tights corresponding to at least the abdomen and the anterior thigh, wherein the predetermined area includes a central region that extends in the width direction from one end side and an opposite end side that respectively pass through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

4. Tights comprising a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and front side of the tights, wherein the predetermined area includes a pair of leg sections that extend downward in a height direction from one end side thereof that passes through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

5. Tights comprising a high elastic portion that is formed in a predetermined area a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and a front side of the tights, wherein the predetermined area includes a pair of lateral sections that obliquely upwardly extend toward a position corresponding to the greater trochanter of the human body from one end side thereof that passes through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

6. Tights comprising a high elastic portion that is formed in a predetermined area of a back side of the tights, which area corresponding to a region of the buttocks and the posterior thigh of the human body in which the skin of the region is stretched greatly when the femoral region of the human body is lifted, the high elastic portion being higher in elastic modulus in the height direction than the area of the back side of the tights other than the predetermined area and a front side of the tights, wherein the predetermined area includes a central region that extends in the width direction from one end side and an opposite end side that respectively pass through or close to intersections, the intersections being formed by crossing an intermediate line located at an intermediate height between a line that conforms to the gluteal sulcus of the human body and a line that connects a pair of highest points of the buttocks to each other, and a pair of lines that each extend in the height direction through substantially the center of the width of the corresponding leg section.

* * * * *